US010405712B2

(12) United States Patent
Collar et al.

(10) Patent No.: US 10,405,712 B2
(45) Date of Patent: Sep. 10, 2019

(54) CLEANING APPARATUS

(71) Applicant: SVT Group Ltd, Northamptonshire (GB)

(72) Inventors: Andrew Collar, Northampton (GB); William Stewart Prince, Northampton (GB)

(73) Assignee: SPACE VAC TECHNOLOGIES GROUP LIMITED (GB)

( * ) Notice: Subject to any disclaimer, the term of this patent is extended or adjusted under 35 U.S.C. 154(b) by 123 days.

(21) Appl. No.: 15/273,844

(22) Filed: Sep. 23, 2016

(65) Prior Publication Data

US 2017/0245709 A1 Aug. 31, 2017

(30) Foreign Application Priority Data

Feb. 29, 2016 (GB) ..... 1603503.2

(51) Int. Cl.
*A47L 5/36* (2006.01)
*A47L 9/24* (2006.01)
*E04D 13/076* (2006.01)

(52) U.S. Cl.
CPC ..... *A47L 5/365* (2013.01); *A47L 9/244* (2013.01); *A47L 9/246* (2013.01); *A47L 9/248* (2013.01);
(Continued)

(58) Field of Classification Search
CPC ..... A47L 5/365; A47L 9/244; A47L 9/246; A47L 9/248; E04D 13/076; E04D 13/0765
See application file for complete search history.

(56) References Cited

U.S. PATENT DOCUMENTS 3,041,655 A * 7/1962 Entler ..... E04D 13/0765 134/167 R
3,971,098 A * 7/1976 Davis ..... A47L 7/0009 15/410
(Continued)

FOREIGN PATENT DOCUMENTS

EP 0882924 12/1998
EP 1661825 5/2006
(Continued)

OTHER PUBLICATIONS

Franks & Co letter dated Mar. 30, 2017, 2 pages.
(Continued)

*Primary Examiner* — Marc Carlson
(74) *Attorney, Agent, or Firm* — Merek, Blackmon & Voorhees, LLC

(57) ABSTRACT

A cleaning apparatus for use in explosive atmospheres is disclosed, the cleaning apparatus being configured to conduct to earth any electrostatic charges generated in the components of the apparatus thereby preventing electrostatic discharge. The apparatus comprises a flexible hose member comprised of an electrically conductive material and having first and second open ends, the hose member being suitable for attachment at its first end to a port of an associated suction unit to mechanically and electrically couple said hose thereto; and a substantially rigid tubular pole member comprised of an electrically conductive material and having first and second open ends, said pole member being mechanically and electrically coupled at said first end to the second end of said hose member.

27 Claims, 12 Drawing Sheets

(52) U.S. Cl.
CPC ..... *E04D 13/076* (2013.01); *E04D 13/0765* (2013.01)

(56) References Cited

U.S. PATENT DOCUMENTS 4,018,493 A * 4/1977 Lyman ..... A47L 9/246 15/377
4,094,535 A * 6/1978 Minton ..... A47L 9/246 174/47
4,121,320 A * 10/1978 Feiner ..... A47L 7/00 15/406
4,319,851 A * 3/1982 Arthur ..... A47L 11/38 134/167 C
4,473,923 A * 10/1984 Neroni ..... A47L 9/246 15/377
4,748,712 A * 6/1988 DiGiovanni ..... A47L 5/36 15/327.5
4,870,535 A * 9/1989 Matsumoto ..... B65G 53/52 361/215
4,940,415 A * 7/1990 Westergren ..... A47L 9/246 439/192
5,056,187 A * 10/1991 Higgins ..... A47L 9/02 15/236.04
5,109,568 A * 5/1992 Rohn ..... A47L 9/242 15/377
D326,747 S * 6/1992 Stickle ..... D32/21
5,195,209 A * 3/1993 Watkins ..... A47L 5/36 15/327.5
5,387,117 A * 2/1995 Moyher, Jr. ..... A47L 9/246 15/314
5,586,360 A * 12/1996 Diederiks, Jr. ..... A47L 9/02 15/410
6,148,474 A * 11/2000 Ohara ..... A47L 9/244 15/377
6,185,782 B1 * 2/2001 Hall ..... A47L 5/14 15/339
6,519,809 B2 * 2/2003 Gutry ..... A47L 9/02 15/327.5
6,766,560 B2 * 7/2004 Murphy ..... A47L 5/14 15/344
7,004,688 B2 * 2/2006 Tasker ..... A47L 5/36 406/39
7,549,191 B2 * 6/2009 Seasholtz ..... E04D 13/0765 15/321
8,561,623 B2 * 10/2013 Lowenstein ..... E04D 13/0765 134/104.2
9,725,908 B2 * 8/2017 Ashton-Miller .... E04D 13/0765
2001/0042284 A1 * 11/2001 Gutry ..... A47L 9/02 15/414
2004/0020516 A1 * 2/2004 Buckner ..... E04D 13/0765 134/21
2004/0143931 A1 * 7/2004 Dennis ..... A47L 5/14 15/414
2005/0022338 A1 2/2005 Muhlenkamp
2005/0233129 A1 10/2005 Capocello
2006/0018722 A1 * 1/2006 Tasker ..... A47L 5/36 406/38
2006/0174441 A1 * 8/2006 Genoa ..... A47L 9/327 15/410
2010/0116941 A1 5/2010 Ciolcyzk et al.
2011/0132405 A1 * 6/2011 Lowenstein ..... B08B 5/04 134/21
2016/0192815 A1 * 7/2016 Bertrand ..... B25G 1/102 15/339

FOREIGN PATENT DOCUMENTS

GB 1516612 7/1978
WO WO 9717880 A1 * 5/1997 ..... A47L 5/365
WO WO-9717880 A1 * 5/1997 ..... A47L 5/365
WO WO 9857006 A1 * 12/1998 ..... B08B 3/026
WO WO-9857006 A1 * 12/1998 ..... B08B 3/026

OTHER PUBLICATIONS

Franks & Co letter dated Apr. 23, 2018, 2 pages.
Withers & Rogers letter dated May 23, 2018, 1 page.
Franks & Co letter dated Jun. 4, 2018, 1 page.
Withers & Rogers letter dated Jul. 2, 2018 with Appendices A through I, 118 pages.
Franks & Co letter dated Jul. 26, 2018, 9 pages.
Withers & Rogers letter dated Aug. 8, 2018, 1 page.

* cited by examiner

CLEANING APPARATUS

CROSS REFERENCE TO RELATED APPLICATIONS

This application claims priority from United Kingdom patent application No. 16 03 503.2 filed Feb. 29, 2016, the whole contents of which are incorporated herein by reference in their entirety.

BACKGROUND OF THE INVENTION

1. Field of the Invention

The present invention relates to a cleaning apparatus, and in particular to a high reach anti-static cleaning apparatus.

2. Description of the Related Art

Vacuum cleaning apparatus are known and used in a variety of situations for lifting debris such as dust, dirt, or other loose contaminants, from a surface. Generally, such vacuum cleaning apparatus include a main suction unit housing an electric motor driven fan and a dust container, and a flexible hose. In use, the electric fan establishes a strong flow of air through the flexible hose, and into the main body, where an air filter element separates dust and debris entrained in the incoming flow of air, causing the separated dust and debris to be deposited in the dust container whilst exhausting the filtered air from the suction unit to the atmosphere. In this way, dust and debris may be lifted from a surface by the flow of air into an open end of the hose, carried by entrainment in the flow of air along the hose to the suction unit, and collected in the dust container for convenient disposal later.

A problem with such conventional vacuum cleaning systems is that of electrostatic discharge from the hose to objects in the surrounding environment. As is well known, the flow of air and entrained dust particles through the hose and associated attachments of the cleaner causes triboelectric charging of the hose and its attachments. This results in a build up of static electric charge in the electrically insulative or electrically isolated conductive components of the hose and attachments. If the hose is then brought sufficiently close to a conductive body, such as a grounded conductive workpiece or earthed metal pipework, an electrostatic discharge may occur.

Such electrostatic discharges are undesirable. They can be damaging to sensitive electronic components, for example, computing equipment, and can result in an unpleasant electric shock to a user of the equipment. Further, a particular problem exists in commercial and industrial situations, in the presence of flammable products, or where gases and airborne particulates create an explosive atmosphere. In such environments, a spark caused by an electrostatic discharge may cause ignition of the atmosphere and result in an explosion. Accordingly, in many jurisdictions, regulations are in place requiring certification of electrical equipment, such as vacuum cleaning apparatus, for use in explosive atmospheres. In Europe, a set of directives and standards referred to as ATEX define the technical requirements to which equipment used in explosive atmospheres must comply, the most recent of which regulations are implemented in the United Kingdom by the Dangerous Substances and Explosive Atmospheres Regulations.

An approach to avoiding static charge build ups, and reducing the risk of electrostatic discharge from vacuum cleaning apparatus, is to connect earthing straps to the hose of the vacuum cleaner. In this way, charge generated in the hose by the passage of air therethrough, is dissipated to ground. However, such arrangements are less than ideal when considering portable equipment, for example, a portable suction cleaning unit, as the earthing straps must remain connected to electrical earth during operation, and so tend to hinder mobility of the apparatus.

A further problem exists however in that it is common for vacuum cleaning units to be equipped with a rigid extendable pole having interchangeable cleaning heads, which is attached to the end of the flexible hose. In this instance, even if the flexible hose were to be grounded using earthing straps, static charge will still accumulate in the other ungrounded components, for example, the cleaning heads, and so the risk of electrostatic discharge is not avoided.

BRIEF SUMMARY OF THE INVENTION

According to a first aspect of the present invention, there is provided a cleaning apparatus comprising a flexible hose member comprised of an electrically conductive material and having first and second open ends, the hose member being suitable for attachment at its first end to a port of an associated suction unit to mechanically and electrically couple said hose thereto; and a substantially rigid tubular pole member comprised of an electrically conductive material and having first and second open ends, said pole member being mechanically and electrically coupled at said first end to the second end of said hose member.

Preferably said flexible hose member and said tubular pole member form a fluid conduit defining internally a substantially continuous passage extending between said first end of said hose member and said second end of said pole member.

Preferably said flexible hose member further comprises a hose coupling apparatus comprised of an electrically conductive material, mechanically and electrically coupled to said first end of said hose member and suitable for attachment to a port of an associated vacuum unit to mechanically and electrically couple said hose thereto.

Preferably said pole member further comprises a pole coupling apparatus comprised of an electrically conductive material, mechanically and electrically coupled to said first end of said pole member and mechanically and electrically coupled to said second end of said hose member.

Preferably said hose coupling apparatus comprises a rotating adapter, said rotating adapter comprising first and second connector portions rotatably and electrically coupled, wherein said second connector portion is mechanically and electrically coupled to said hose member at said first end, and said first connector portion is suitable for attachment to a port of an associated vacuum suction unit to mechanically and electrically couple said hose to said suction unit.

Preferably said pole member is comprised of a carbon-fibre reinforced polymer material.

Preferably said pole member comprises of a plurality of interconnected pole sections.

Preferably said pole sections are constructed from a carbon-fibre reinforced polymer material using the pultrusion process.

Preferably said pole sections of said plurality of pole sections are interconnected by partially inserting an end of a first said pole section into an end of a second said pole section.

Preferably said plurality of interconnected pole sections are retained in the connected configuration by retaining clips which engage adjacent pole sections.

Preferably said plurality of interconnected pole sections define apertures proximal their connecting ends configured to be aligned when an end of a first said pole section is partially inserted into an end of a second said pole section, and said retaining clips include a projecting element configured to be received through said aligned apertures in said interconnected configuration.

Preferably said apparatus further comprises a pole head component, mechanically and electrically coupled to said second end of said pole member to facilitate a suction cleaning operation.

Preferably said pole head component comprises an angled section of rigid tubing.

Preferably said pole head component further comprises a nozzle apparatus mechanically and electrically coupled thereto.

Preferably said flexible hose member is comprised of an electrically conductive plastics material.

Preferably said hose coupling apparatus and said pole coupling apparatus each comprise of an electrically conductive plastics material.

Preferably said apparatus further comprises a vacuum suction unit, said vacuum suction unit defining a passage extending between an inlet port and an outlet port, and comprising a motor driven fan interposed in said passage and configured to generate a flow of air along said passage from said inlet port towards said outlet port.

Preferably said vacuum suction unit includes an electrically conductive member proximal said inlet port, said electrically conductive member being configured for connection to electrical ground.

Preferably said flexible hose member is mechanically coupled to said inlet port of said vacuum suction unit and electrically coupled to said electrically conductive member.

Preferably said apparatus is configured as a high reach suction cleaning apparatus.

According to a second aspect of the present invention there is provided a kit of parts for assembling a cleaning apparatus, the kit comprising, a flexible hose member comprised of an electrically conductive material and having first and second open ends, the hose member being suitable for attachment at its first end to a port of an associated suction unit to mechanically and electrically couple said hose thereto; and a substantially rigid tubular pole member comprised of an electrically conductive material and having first and second open ends, said pole member being configured to be mechanically and electrically coupled at said first end to the second end of said hose member.

Preferably said flexible hose member and said tubular pole member are configured to form a fluid conduit defining internally a substantially continuous passage extending between said first end of said hose member and said second end of said pole member.

Preferably said flexible hose member further comprises a hose coupling apparatus comprising an electrically conductive material, the hose coupling apparatus being configured to be mechanically and electrically coupled to said first end of said hose member and suitable for attachment to a port of an associated vacuum unit to mechanically and electrically couple said hose thereto.

Preferably said pole member further comprises a pole coupling apparatus comprised of an electrically conductive material configured to be mechanically and electrically coupled to said first end of said pole member and configured to be mechanically and electrically coupled to said second end of said hose member.

Preferably said hose coupling apparatus comprises a rotating adapter, said rotating adapter comprising first and second connector portions rotatably and electrically coupled, wherein said second connector portion is configured to be mechanically and electrically coupled to said hose member at said first end, and said first connector portion is suitable for attachment to a port of an associated vacuum suction unit to mechanically and electrically couple said hose to said suction unit.

Preferably said kit further comprises a vacuum suction unit, said vacuum suction unit defining a passage extending between an inlet port and an outlet port, and comprising a motor driven fan interposed in said passage and configured to generate a flow of air along said passage from said inlet port towards said outlet port.

According to a third aspect of the present invention, there is provided a high reach cleaning apparatus comprising a flexible hose member comprised of an electrically conductive material and having first and second open ends, the hose member being suitable for attachment at its first end to a port of an associated suction unit to mechanically and electrically couple said hose thereto; and a substantially rigid tubular pole member comprised of an electrically conductive material and having first and second open ends, said pole member being mechanically and electrically coupled at said first end to the second end of said hose member.

BRIEF DESCRIPTION OF THE DRAWINGS

The invention will now be described by way of example only with reference to the accompanying drawings, which are purely schematic and not to scale, of which.

DETAILED DESCRIPTION OF EXAMPLE EMBODIMENTS

FIG. 1

Figure 1:
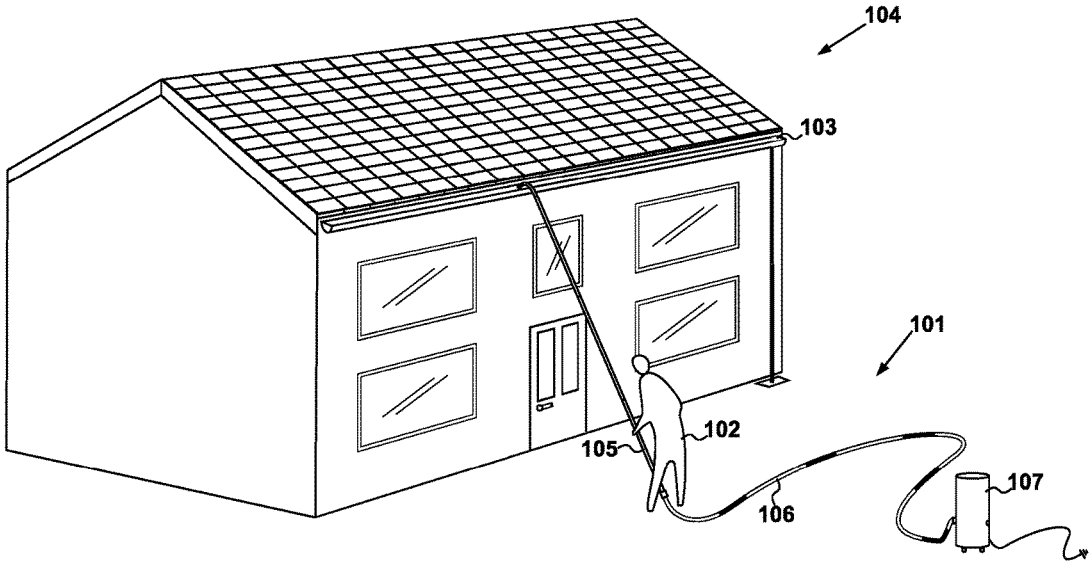
FIG. 1 is an illustration of an exemplary embodiment of the cleaning apparatus of the present invention in use.

A cleaning apparatus 101 according to an exemplary embodiment of the present invention is shown in FIG. 1. In the present example, cleaning apparatus 101 is configured as a high-reach anti-static cleaning apparatus, suitable for cleaning areas of buildings that are elevated from ground level.

As illustrated in the Figure, an operative 102 is using the cleaning apparatus 101 to remove debris, from the gutter 103 of residential building 104. As the skilled person will be aware, guttering's on buildings require frequent cleaning to remove debris, such as leaves and twigs for example, that have accumulated in the gutter over time. Failure to remove such accumulations will eventually result in the gutter becoming blocked, which will prevent rainwater from flowing along the gutter to the downpipe, and will cause the rainwater to instead overflow the sides of the gutter. Conventionally, such a cleaning operation would require an operative to climb a ladder to empty the gutter by hand. Not only is such an operation very time consuming, due to the requirement to descend and reposition the ladder frequently in order to access the full length of the gutter, but also presents hazards associated with working at heights, requiring operatives to undergo specific training.

As shown in the Figure, in the present example, cleaning apparatus 101 comprises generally of three portions, a substantially rigid tubular pole member 105, a flexible hose member 106, and a vacuum suction unit 107. As will be described in further detail with reference to later Figures, the pole member 105, and hose member 106 are comprised of an electrically conductive material, and the pole member 105 is mechanically and electrically coupled to the hose member 107. The hose member is mechanically and electrically coupled to the vacuum suction unit 107, which is in turn electrically earthed. In this way, static charges generated in the pole member and the hose member are conducted to earth via the suction unit 107, thereby preventing electrostatic discharge from the pole member 105 or the hose member 106, to objects in the vicinity.

In the specific example described herein, the cleaning apparatus 101 is designed for use in explosive atmospheres, such as may be encountered in a factory setting where combustible materials are present. As the skilled person will be aware, the flow of air and entrained dust particles through pole member 105 and hose member 106, will tend to cause triboelectric charging of the walls of the components. To prevent static charge from accumulating in the components of the cleaning apparatus to a level where an electrostatic discharge capable of igniting combustible materials in the environment might result, the components of the cleaning apparatus are electrically earthed such that the static charges may be conducted to earth. In this respect, the apparatus is considered anti-static, in as much that although trioboelectric charging of the pole member 105 and hose member 106 does occur, the charges are conducted to earth rather than being allowed to accumulate to a level at which an electrostatic discharge having sufficient energy to ignite the atmosphere could result.

It will be appreciated by the skilled person in the science that reference to electrical "earth" or "ground", and an element being electrically "earthed" or "grounded" in this description encompasses both the case of being physically connected to earth or to a current carrying body capable of providing a zero voltage reference level. Thus, the terms "earth" and "ground" as used herein refer to the general case of a body that can be approximated as capable of providing an infinite source of, and sink for, electrical charge, and can thus absorb an unlimited amount of current without a change in potential of the element connected to it.

Further, it is appreciated that the description of various components of the apparatus as being 'electrically conductive' is subjective to some extent, as it is understood that even materials that may conventionally be considered electrically insulative will conduct electricity when a voltage exceeding the material's breakdown voltage is applied. However, it will be apparent to the skilled person that references herein to a material being 'electrically conductive' refers to a material that will allow the flow of electricity of a voltage typical of static charge generated by the flow of air and debris particles through the pole member 105 and hose member 106, and more preferably a material that presents a low resistance to the flow of such a voltage, and which is a good conductor of static electricity. It is preferably therefore that the various components of the cleaning apparatus 101 that will be described herein, including the various components of the pole member 105 and the hose member 106, are comprised of materials having electrical conductivities in the range of $1\times10^{-6}$ Sm−1 to $1\times10^{8}$ Sm−1, and more preferably in the range of $1\times10^{-4}$ Sm−1 to $1\times10^{8}$ Sm−1, and which exhibit volume resistivity in the range of $1\times10^{5}$ Ωm−1 to $1\times10^{-8}$ Ωm−1

FIG. 2

Figure 2:
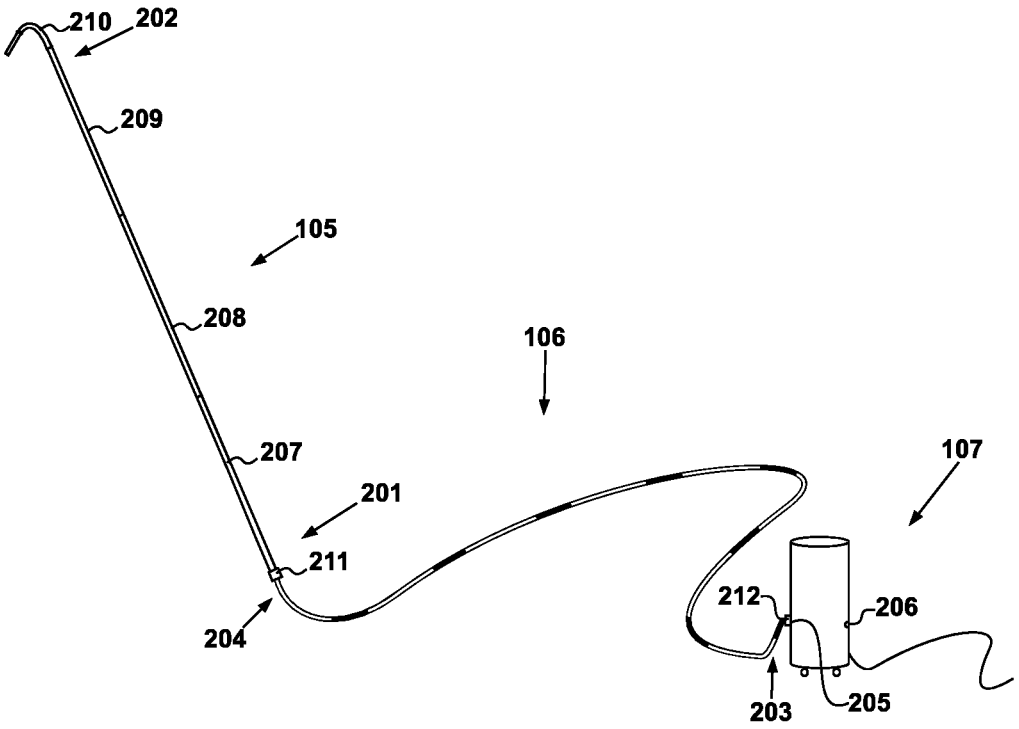
FIG. 2 shows the cleaning apparatus previously identified in FIG. 1 in isolation.

The cleaning apparatus 101, described in use previously with reference to FIG. 1, is shown in isolation in FIG. 2.

As previously described, the cleaning apparatus comprises generally of rigid tubular pole member 105 having first and second open ends 201, 202, a flexible hose member 106 having first and second open ends 203, 204, and a vacuum suction unit 107 having inlet and outlet ports 205, 206. The pole member 105 and hose member 106 are mechanically coupled together at their first and second ends respectively creating a substantially fluid tight joint thereby forming a substantially continuous conduit defining internally a substantially sealed fluid passage extending between the first end 203 of the hose member 106 and the second end 202 of the pole member 105. The hose member 106 is then mechanically coupled at its first end 203 to the inlet port 205 of vacuum suction unit 107 creating a substantially fluid tight joint therebetween.

In this way, when the vacuum suction unit is turned on, a flow of air is established in through the open second end 202 of the pole member 105, along the pole member 105 and hose member 106, through the inlet 205 of suction unit 107, and exiting through outlet 206. In this way, when the second end 202 of pole member 105 is inserted into gutter 103, debris in the gutter will tend to become entrained in the inflow of air, and will be carried with the air to be collected in the vacuum suction unit.

Referring to the Figure, in the specific embodiment, pole member 105 is comprised of a plurality of individual interconnected pole sections 207 to 209, and an angled head piece 210. Pole 105 is further provided with a pole coupling apparatus 211 mechanically and electrically coupled to the first end 201 of the pole member 105, and mechanically and electrically coupled to the second end 204 of the hose member 106. Pole 105 will be described further with reference to FIGS. 3 to 5, and the pole coupling apparatus 211 will be described further with particular reference to FIGS. 8*a* and 8*b*.

In the embodiment, hose 106 comprises of a length of corrugated plastics tubing and is flexible along its length. Hose 106 is further provided with a hose coupling apparatus 212 mechanically and electrically coupled to its first end 203, and mechanically and electrically coupled to the inlet port 205 of vacuum suction unit 107. Hose 106 will be described further with reference to FIGS. 6*a* and 6*b*, and hose coupling apparatus 205 will be described further with reference to FIGS. 9*a* and 9*b*.

In the specific embodiment, the cleaning apparatus further includes a vacuum suction unit 107 including a motor driven fan which generates a flow of air across the unit from inlet 205 to outlet 206. The configuration of vacuum suction unit 107 will be described further with reference to FIG. 7.

FIG. 3

Figure 3:
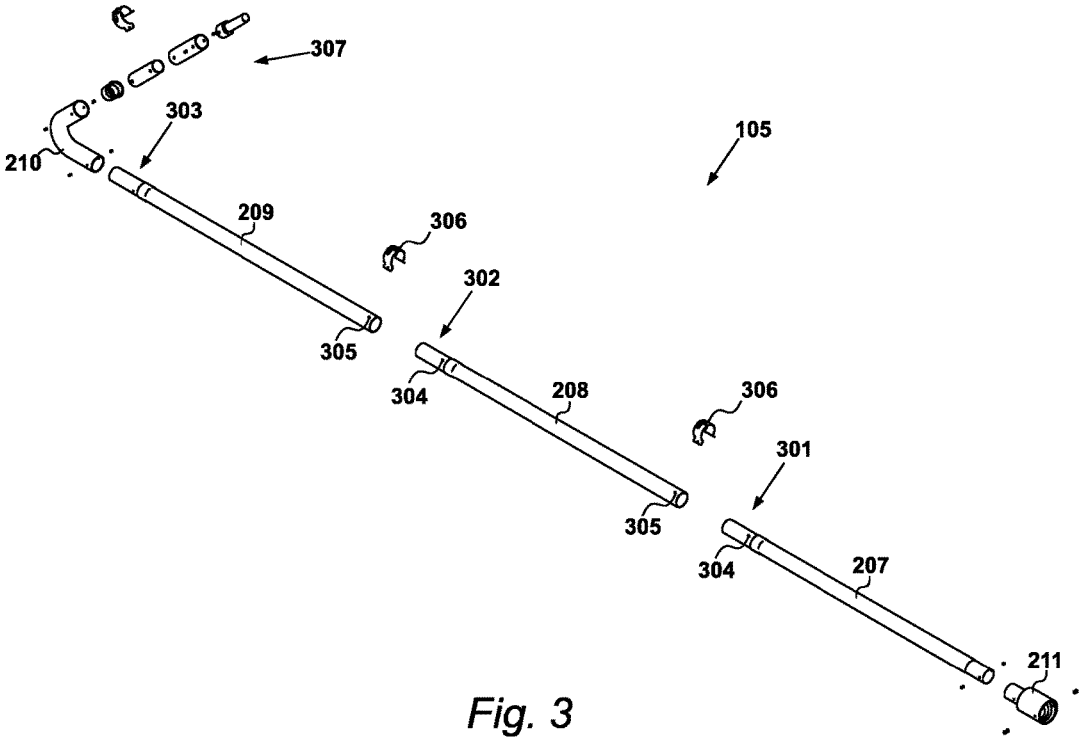
FIG. 3 is an exploded isometric view of the pole member.

The pole member 105 is shown in an exploded isometric view in FIG. 3.

Pole member 105 is comprised of a plurality of individual pole sections, in the example, three pole sections 207 to 209, which are mechanically and electrically coupled together as will be described. Pole sections 207 to 209 are substantially identical in construction, save as will be later described, each comprising a hollow tubular rod approximately one meter in length having an outer diameter of approximately thirty-eight millimeters, and a wall thickness of around two millimeters, formed of a carbon-fibre reinforced polymer material.

Pole sections 207 to 209 are formed using the pultrusion method from a carbon fibre weave consisting of one-hundred percent carbon fibre material coated in a binding polymer, for example, a thermosetting resin such as epoxy resin, which is pulled through a tubular die, with the carbon fibre strands extending the full length of each pole section from end to end. The high content of carbon fibre strands in the weave, and the configuration of the strands extending the full length of each pole section, ensures good electrical conductivity along the length of each pole section. In the example, the poles comprise of a carbon fibre reinforced polymer material having an electrical resistivity of approximately $1\times10^{-4}$ Ωm−1, and are thus considered to be a conductive anti-static material.

Each said pole section is connected to an adjacent pole section by either partially inserting its end into the end of an adjacent pole section, or having the end of an adjacent pole section partially inserted into its end. Thus, an end of pole section 207 is inserted into an end of pole section 208 to a depth of approximately one-hundred millimeters, and the opposite end of pole section 208 is inserted into an end of pole section 209. To facilitate this partial insertion, the thickness of the wall of each said pole section is reduced marginally at one of its ends, for example by reducing the thickness of the wall to around one millimeters, to form a reduced thickness region 301 to 303. This results in the outer diameter of an end of each pole section being approximately equal to the inner diameter of the end of the adjacent section into which it is to be inserted, and so results in a close interference fit between adjacent pole sections, making good surface contact, and ensuring good electrical conductivity across the joint.

Figure 11A:
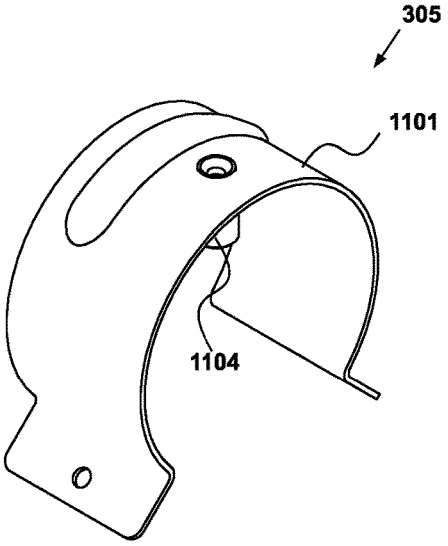
FIG. 11*a* is a perspective view of the clip.
Figure 11B:
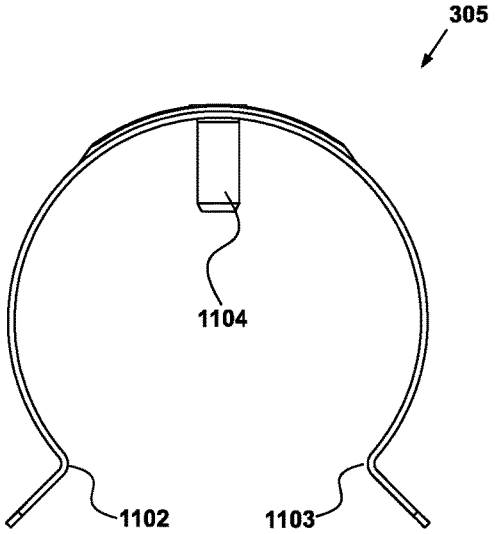
FIG. 11*b* is a side view of the clip.

As illustrated in the Figure, pole sections 207 and 208 each define apertures 304 proximal their upper ends, and pole section 208 and 209 each define apertures 305 proximal their lower ends. The apertures are positioned such that when the pole sections are correctly connected as previously described, the apertures in adjacent pole sections align. A clip 305 is thus further provided, in the form generally of a U-shaped strip of metal, having a pin projecting inwardly from its inner surface, configured to be received through the aligned apertures to engage each said pole section. Clip 305 thus ensures that adjacent pole sections remain mechanically coupled during use, and prevent accidental separation of the poles. The clip also further improves the electrical coupling between the two adjacent pole sections as the electrically conductive pin engages both pole sections. Clip 306 will be described in further detail with reference to FIGS. 11*a* and 11*b*.

As shown in the Figure, pole 105 is further provided with a pole head component 210, mechanically and electrically coupled to the upper end of pole section 209, which in turn has a nozzle apparatus, indicated generally at 307, mechanically and electrically coupled to its end. Pole head component 219 and nozzle apparatus 307 will be described in further detail with reference to FIGS. 3 and 4 respectively.

This construction of pole member 105 allows for easy separation of the pole sections to thereby reduce the length of the pole member, which facilitates easy transport. Further, the modular construction allows the length of the pole member to be varied to suit the requirements of the particular application. Thus, for example, in the example the pole member 105 comprises three pole sections, each having a length of approximately one meter, giving the pole member 105 a total length of three meters, which is an appropriate length for cleaning the gutter of residential building 104. If however the cleaning apparatus were to be deployed to clean the roof of a factory, which may be relatively higher from floor level, additional pole sections identical to pole section 208 may be provided, to thereby increase the overall length of the pole member.

FIG. 4

Figure 4:
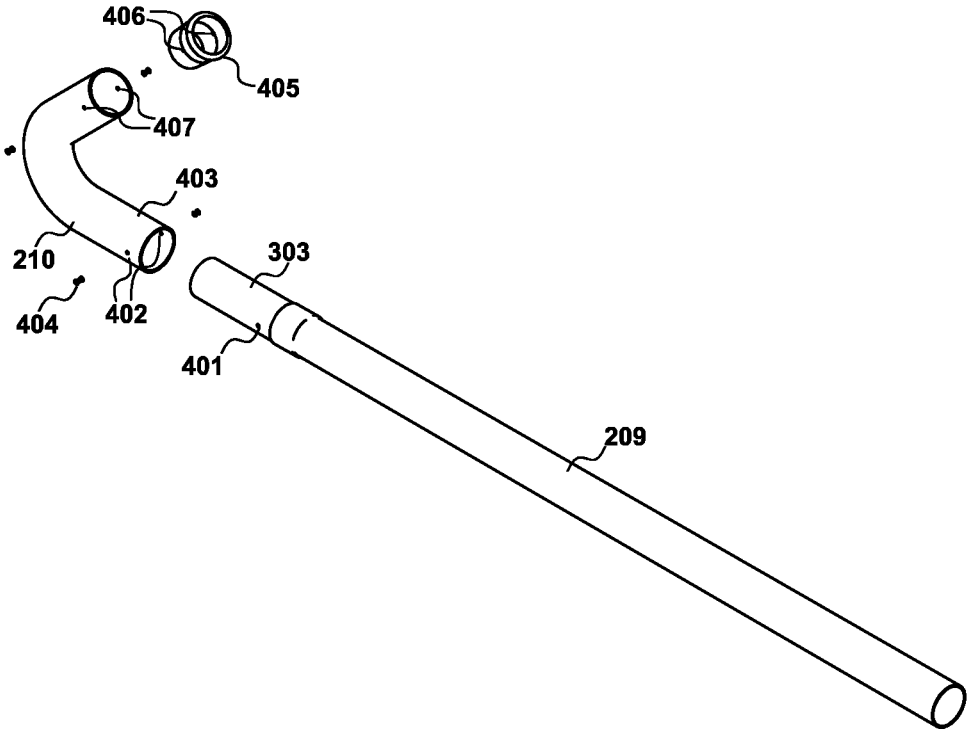
FIG. 4 is an exploded isometric view of the pole section and the pole head component.

The pole section 209 and pole head component 210 are shown in an exploded isometric view in FIG. 4.

In the embodiment, pole head component 210 comprises of section of hollow aluminium tubing. Head component 210 is formed into an angled tube, in which the tube axis is bent along its length to define an angled section. In this case, the tube axis defines an angle of approximately 130 degrees.

As illustrated, in the specific embodiment, pole section 209 differs from pole sections 207 and 208 in that it includes a pair of diametrically opposed apertures 401 proximal its reduced thickness end 303. Similarly, head component 210 includes a pair of corresponding diametrically opposed apertures 402 proximal its first end 403. Thus, head component 210 is attached to the end of pole section 209 by inserting the end of the pole section 209 a short distance into the first end 402 of the head component, similar to the way in which the pole sections themselves are connected, until the apertures 402 of the head component are aligned with the apertures 401 of the pole section 209. Fasteners, in the form of blind metal rivets 404, are then inserted through the apertures to secure the head component 210 to the end of pole section 209. Again, this prevents accidental separation of the head component from the pole section during use, and improves electrical conductivity across the joint.

Head component 210 is further provided with a nozzle adapter socket 405, which is inserted into an opposite end of the head component to that of pole section 209, to facilitate attachment of a nozzle component to the end of head component 210. Nozzle adapter socket 405 includes a pair of diametrically opposed apertures 406 configured to align with diametrically opposed apertures 407 defined proximal the end of said head component. Nozzle adapter socket 405 will be described in further detail with reference to FIGS. 10*a* and 10*b*.

FIG. 5

Figure 5:
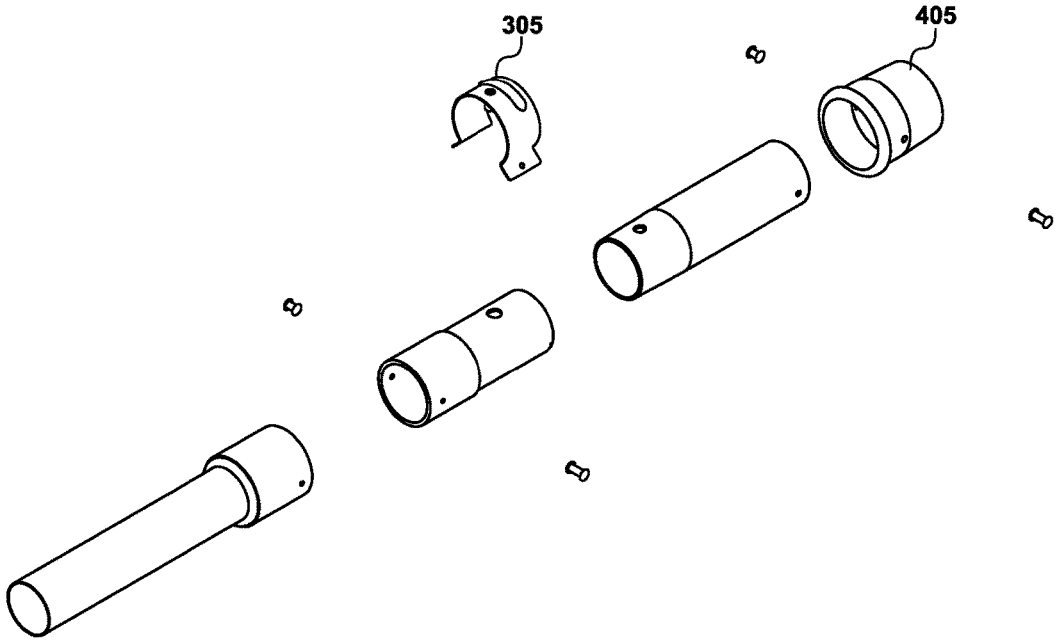
FIG. 5 is an exploded isometric view of the components of the nozzle apparatus.

The components of the nozzle apparatus 307 are shown in an exploded isometric view in FIG. 5.

Referring to the Figure, in the embodiment the nozzle apparatus 307 comprises of stem parts 501, 502, nozzle 503, and clip 305. First stem part 501 is slidably received inside nozzle adapter socket 405, having an outer diameter closely matched to the internal diameter of adapter socket 405, ensuring good surface contact and electrical conductivity. First stem part 501 has diametrically opposed apertures 504 proximal its first end, configured to align with the diametrically opposed apertures 406 of adapter socket 405, and diametrically opposed apertures 407 of head component 210, and further includes blind rivets 404 received through apertures 406, 407 and 504, to thereby secure the first stem part 501 to the end of head component 210, preventing accidental separation during use, and ensuring good electrical conductivity across the joint.

The outer diameter of the second end of first stem part 501 is reduced to allow insertion of the second end of first stem part 501 into the first end of the second stem part 502. First stem part 502 has an aperture 505 at its second end configured to align with aperture 506 in said second stem part 502, with the projecting pin of clip 305 being received through the apertures to thereby releasably secure the two stem parts together.

The second end of said second stem part 502 is configured to be received in the end of said nozzle component 503, by partially inserting the second stem part 502 into the nozzle component 503, until diametrically opposed apertures 507 of second stem part 502 are aligned with diametrically opposed apertures 508 of nozzle component 503. A pair of blind rivets 404 are then received through said apertures to mechanically couple the nozzle component to the second stem part, and ensure good electrical conductivity therebetween.

In the embodiment, the first stem part 501, and second stem part 502 are each comprised of an electrically conductive material, which in the specific example is an aluminium material.

FIG. 6

Figures 6A, 6B:
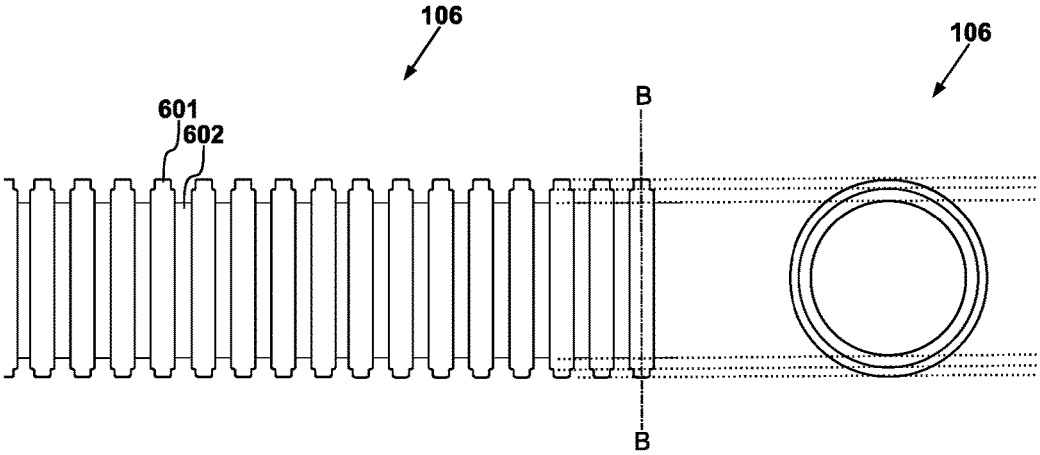
FIG. 6*a* is a side view of the flexible hose member.
FIG. 6*b* is a cross-sectional view of the flexible hose member.

The flexible hose member 106 is shown in a side view in FIG. 6*a* and in a cross-sectional view in FIG. 6*b* along the line B-B.

In the embodiment, the flexible hose member 106 comprises of a length of corrugated hose, having an outer diameter of approximately forty millimeters, and defining internally a fluid passage. Flexible hose member 106 is substantially conventional in construction, and defines externally a series of ridges 601 and furrows 603.

Flexible hose member 106 comprises of an electrically conductive plastics material, for example, a plastics polymer filler material including a dispersion of micro-scale discrete conductive particles, such as nickel particles, carbon black, silver particles, or graphite particles, which in the specific example is a nylon plastics filler material comprising a dispersion of carbon black particles. In the specific embodiment, said hose member 106 is comprised of a material having a resistivity of around $1\times10^3$ Ωm−1.

FIG. 7

Figure 7:
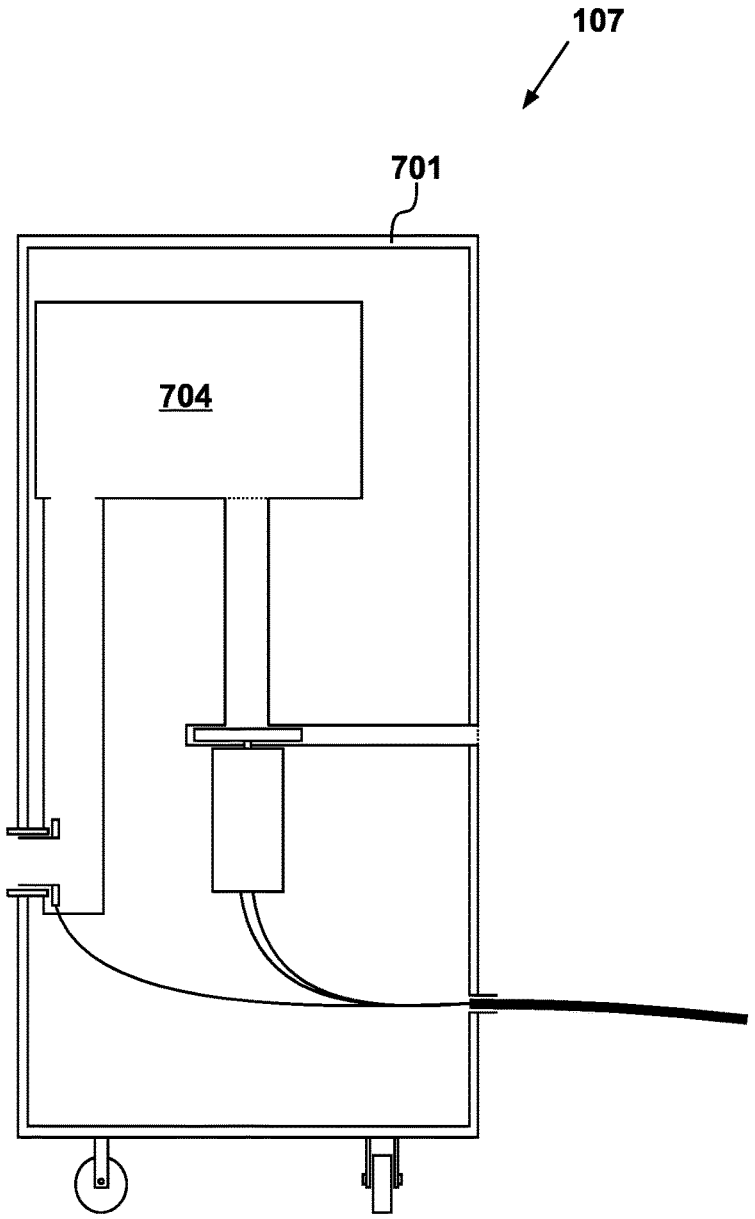
FIG. 7 is a cross-sectional view of the vacuum suction unit.

A cross sectional view is shown in FIG. 7 of the vacuum suction unit 107 described previously in FIGS. 1 and 2.

The function of vacuum suction unit 107 in this application is twofold. Firstly, vacuum suction unit 107 functions as an air pump, used to generate a flow of air in through the end of pole member 105, in a manner of a conventional vacuum cleaner with which the skilled person will be entirely familiar. Secondly, vacuum suction unit 107 functions as an electrical earthing point, through which static charges generated in the pole member 105 and hose member 106 by the flow of air therethrough, may conveniently be conducted to earth.

Referring to the Figure, vacuum suction unit 107 includes a generally cylindrical main body 701 comprised of a plastics material, serving primarily to house the various functional components, and which defines an inlet port 205 and outlet port 206. An AC electric motor 702 equipped with a centrifugal fan 703, and a dust collection container 704 equipped with air filter element 705 are provided inside the main body 701. The container 704 and fan 703 are interposed in series in a passage 707 extending between the inlet port 205 and outlet port 206, the passage being defined by conduits 708 and container 704. In this way, when electric motor 702 is energised by application of an electrical current, rotation of fan 703 causes a flow of air to be established inwardly through inlet port 205, along passage 707. As the flow of air passes through container 704, dust and other particles of debris entrained therein are separated from the flow by filter element 705, and are collected in container 704. The filtered air continues along the passage, through the blades of fan 703, and is exhausted from the main body to atmosphere through outlet port 206.

In the embodiment, vacuum suction unit 107 is configured to operate using single phase alternating current, and is configured for connection to a domestic mains circuit. Vacuum suction unit 107 thus further comprises conductive cabling 709, which includes neutral, line and earth conductor wires 710, 711, 712 respectively, configured for connection to corresponding conductors of a domestic ring-main circuit.

As illustrated in the Figure, in the embodiment, vacuum suction unit 107 further comprises an electrically conductive member, indicated generally at 713, in the form generally of a conductive metal collar attached to main body 701 proximal the inlet port, and having flange 714 arranged to extend about the internal circumference of the inlet port 205. In this way the flange 714 is brought into electrical contact with the hose coupling apparatus 212 when hose coupling apparatus 212 is inserted into inlet port 205. Conductive member 713 is electrically coupled to the earth conductor wire 712 of conductive cabling 709, and in this way electrically couples hose coupling apparatus 212 to earth conductor 712, which is in turn configured in use for connection to an earth conductor of a mains electrical circuit.

In the embodiment, vacuum suction unit 107 includes earthed collar member 713, which is arranged proximal the inlet port and configured to make electrical contact with the hose coupling apparatus 212, when the hose coupling apparatus is inserted into inlet port 205. This is necessary in the embodiment as the main body 701 of vacuum suction unit 107 is comprised of an electrically insulating plastics material, and thus without the earthed collar member 713, electrical charge would not be conducted across the suction unit to earth conductor 712. It will of course be appreciated however that alternative configurations of the suction unit are available, in which charge is conducted from the hose coupling apparatus 212 to earth. For example, in an alternative embodiment, the main body 701 may be comprised of an electrically conductive material, for example, aluminium, which main body may itself be electrically coupled to earth conductor 712. In this way, when hose coupling apparatus 212 is inserted in inlet port 205, electrical charge will be conducted from hose member 106, across main body 701, to earth conductor 712.

Further, it will be appreciated that the vacuum suction unit 107 may take a number of alternative configurations, and the invention is not intended to be limited to the specific example illustrated herein. For example, in alternative embodiments, the vacuum suction unit may instead use an electric motor operating on a three-phase electrical current, or as further alternative, the electric motor 702 may be replaced with a pneumatic motor.

FIG. 8

Figure 8A:
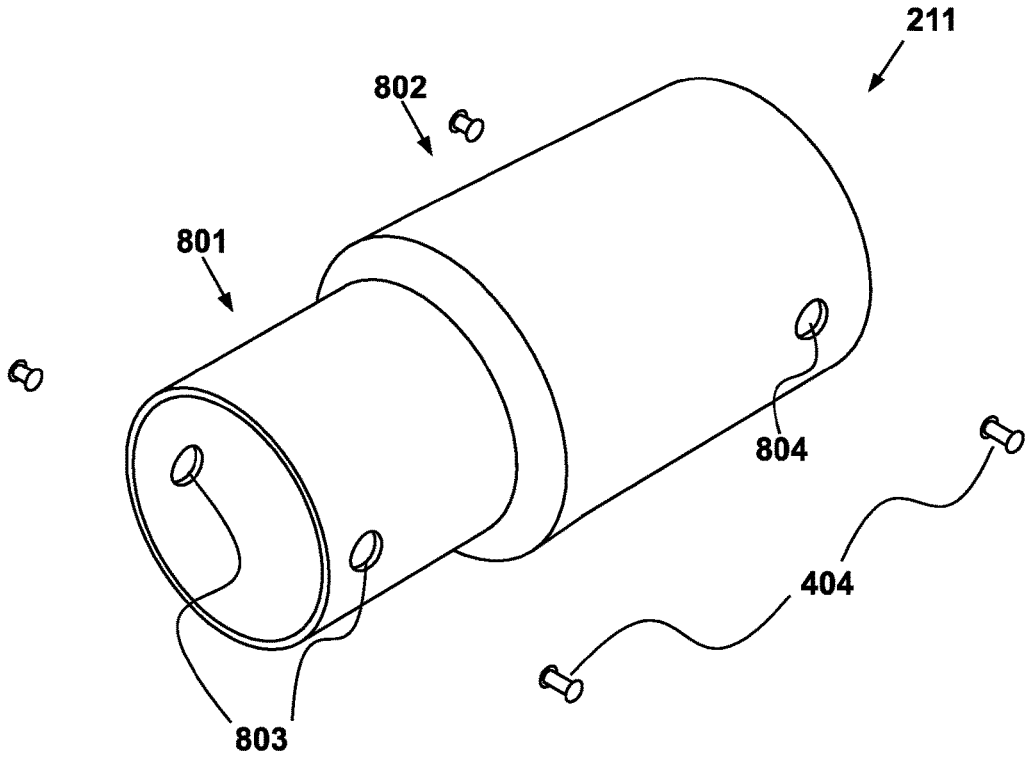
FIG. 8*a* is a perspective view of the pole coupling apparatus.
Figure 8B:
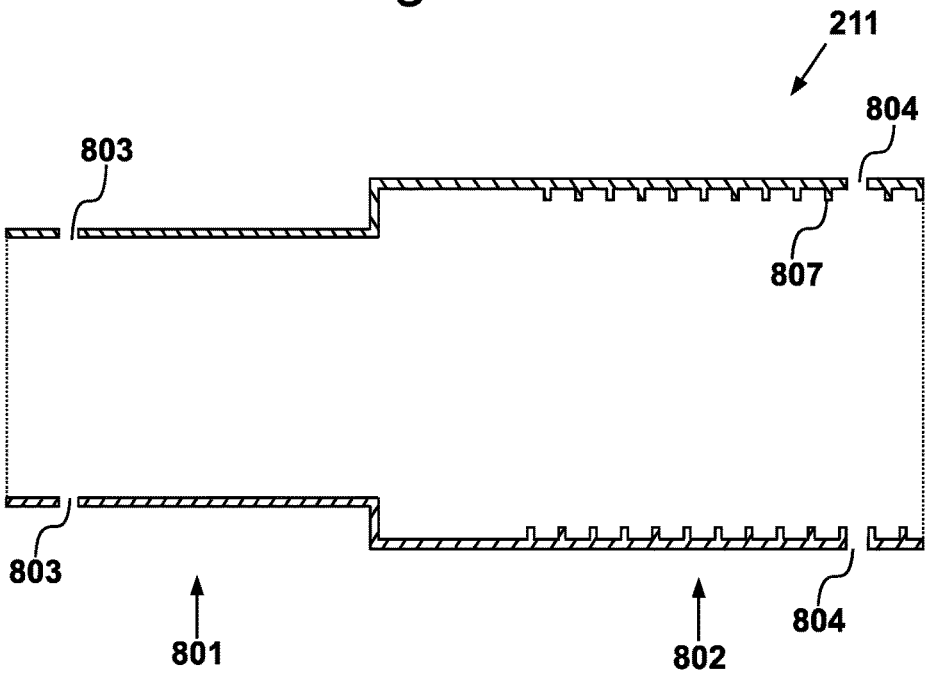
FIG. 8*b* is a side cross-sectional view of the pole coupling apparatus.

The pole coupling apparatus 211 is shown in a perspective view in FIG. 8*a* and in a side cross-sectional view in FIG. 8*b*.

In the example, pole coupling apparatus has a single piece tubular construction, and defines generally a first tube portion 801 and a second tube portion 802. In the embodiment, the pole coupling apparatus 211 is comprised of an electrically conductive plastics material. In the specific example, the hose coupling apparatus 211 is comprised of the same electrically conductive plastics material as said hose 106, and comprises of a nylon plastics filler material comprising a dispersion of discrete carbon black particles having a resistivity of around $1\times10^3$ Ωm−1.

The first tube portion 801 is configured to receive the first end of said first pole section 207, and includes diametrically opposed apertures 803, configured to align with the diametrically opposed apertures proximal the first end of said first pole section, through which aligned apertures blind metal rivets 404 are inserted to mechanically couple the apparatus 211 to the pole section 207. The first tube portion 801 has an inner diameter closely matched to the outer diameter of said pole section 207, ensuring good surface contact, and electrical conductivity therebetween.

The second tube portion 802 is configured to receive an end of the flexible hose member 106, and defines internally a helical thread 804, which threads are configured to engage in furrows 602 of said flexible hose member, to connect the two. The second tube portion 802 is again provided with diametrically opposed apertures 804, configured to align with corresponding apertures defined proximal an end of said flexible hose member, and through which blind metal rivets 404 are inserted to mechanically couple the components. Again, the inner diameter of said second tube portion 802 is closely matched to the outer diameter of said hose member 106, which maintains electrical conductivity therebetween.

FIG. 9

Figure 9A:
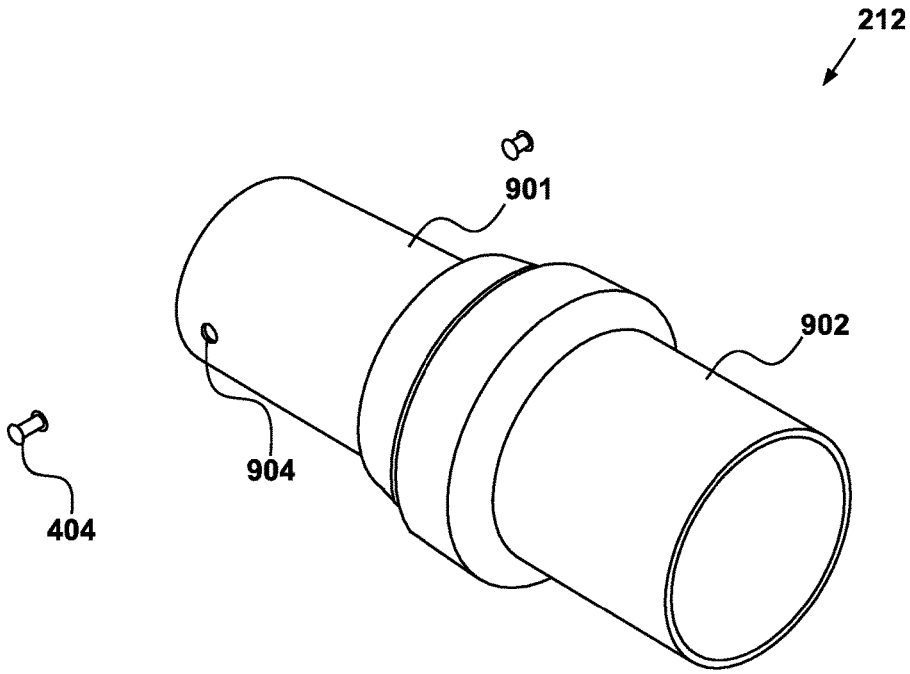
FIG. 9*a* is a perspective view of the hose coupling apparatus.
Figure 9B:
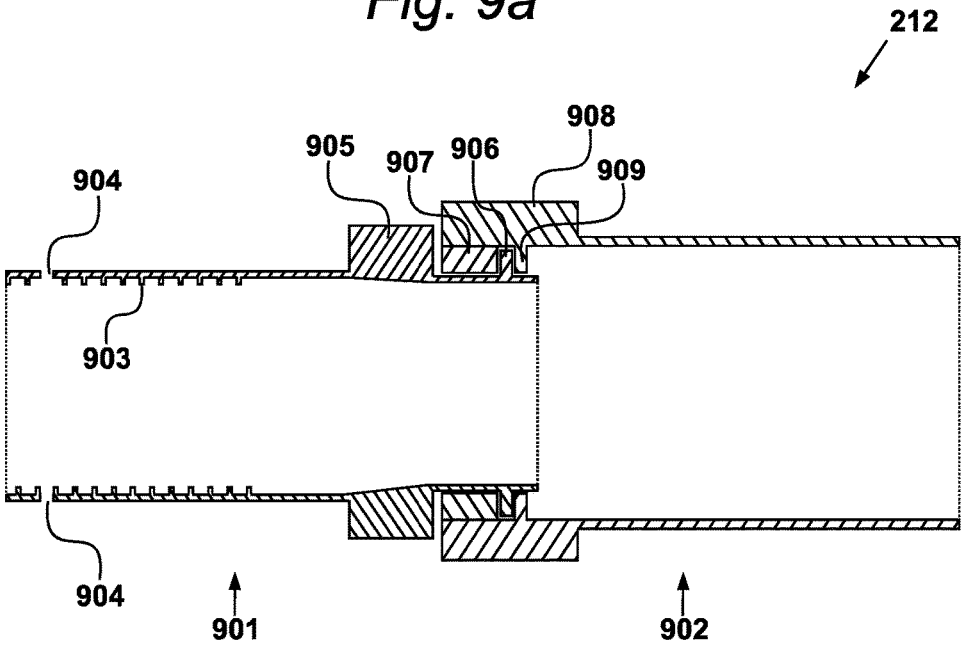
FIG. 9*b* is a side cross-sectional view of the hose coupling apparatus.

The hose coupling apparatus 212 is shown in a perspective view in FIG. 9*a* and in a side cross-sectional view in FIG. 9*b*.

In the specific example illustrated, the hose coupling apparatus is configured as a rotating adapter, and comprises of first and second connector portions 901, 902, that are rotatably and electrically coupled. This type of rotator coupling is preferred as it allows relative rotation between the hose member 107 and the vacuum suction unit 107, whilst maintaining mechanical and electrical coupling and ensuring a fluid tight seal therebetween.

The first connector portion 901 is configured to receive an end of the flexible hose member 106, and defines internally a helical thread 903, which threads are configured to engage with furrows 602 of said flexible hose member, to connect the two. The first connector portion 902 is also provided with diametrically opposed apertures 904, configured to align with corresponding apertures defined proximal an end of said flexible hose member, and through which blind metal rivets 404 are inserted to mechanically couple the components.

The second connector portion 902 is configured to be inserted into the inlet port 205 of said vacuum suction unit 107, and has an outer diameter closely matched to the inner diameter of said inlet port 205. In this way, a good interference fit is achieved between the connector portion 902 and the inlet port 205, mechanically and electrically coupling the coupling apparatus 212 to the vacuum suction unit 107. It will of course be appreciated however that said second connector portion 902 may be mechanically coupled to the vacuum suction unit by a mechanism other than an interference fit, for example, using a mechanical clip, or by way of co-operative threads on the two parts.

Referring particularly to FIG. 9*b*, it can be seen that said first connector portion 901 comprises an annular collar 905 and annular flange 906 proximal its end that is coupled to said second connector portion, and further comprises a ring 907 arranged loosely about the recess defined between said collar 905 and said flange 906, the ring 907 having an outer diameter closely matched to the internal diameter of said second connector portion 902. Said second connector portion 902 similar defines an annular collar 908, and an annular flange 909. In this way, the coupling apparatus 212 is assembled by slidably inserting the first connector portion 901 into the end of the second connector portion 902, until the collar 905 abuts the collar 908. In doing so, ring 907 is forced into the end of said second connector portion, and as a result of the interference fit between the outer circumference of the ring and the inner surface of the second connector portion, the flange 906 is retained in the recess defined between the flange 909 and the ring 907, thus mechanically coupling the two connector portions.

It will be appreciated that, although for illustrative purposes, a small gap is illustrated between the first connector portion and the second connector portion, in practise the two connector portions will be in good surface contact, thus ensuring good electrical conductivity across the joint.

In the embodiment, the hose coupling apparatus 212 is comprised of an electrically conductive plastics material. In the specific example, the hose coupling apparatus 212 is comprised of the same plastics material as the flexible hose 106 and the pole coupling apparatus 211 and comprises of a nylon plastics material comprising a dispersion of discrete carbon black particles having a resistivity of around $1\times10^3$ Ωm−1.

FIG. 10

Figures 10A, 10B:
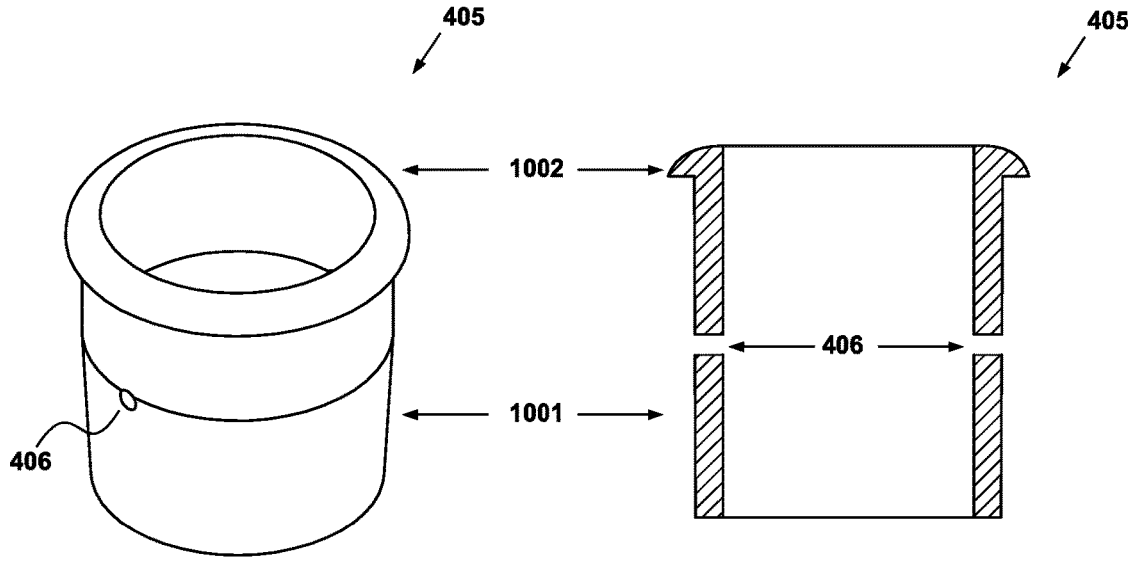
FIG. 10*a* is a perspective view of the nozzle adapter socket.
FIG. 10*b* is a side cross-sectional view of the nozzle adapter socket.

The nozzle adapter socket 405 previously identified in FIG. 4 is shown in a perspective view in FIG. 10*a* and in a side cross-sectional view in FIG. 10*b*.

Nozzle adapter socket 405 includes a tube section indicated generally at 1001, defining a pair of diametrically opposed apertures 406, and an annular end flange 406. The nozzle adapter socket 405 is configured for the first stem part 501 to be inserted into the end of the head component 210, the outer diameter of which is closely matched to the internal diameter of the head component 210 to ensure good contact therebetween, until the flange 1002 is brought into contact with the end of the tube section. In use, the nozzle adapter socket 405 is inserted into the end of the hose section, and receives an end of a nozzle, such as that which will be described further with reference to FIGS. 12*a* to 12*c*.

In the embodiment, the nozzle adapter socket 405 is comprised of the same electrically conductive plastics material as said hose coupling apparatus 212, flexible hose 106, and pole coupling apparatus 211, and comprises of a nylon plastics material comprising a dispersion of discrete carbon black particle having a resistivity of around $1\times10^3$ Ωm−1.

FIG. 11

The clip 305 previously identified in FIG. 3 is shown in a perspective view in FIG. 10*a* and in a side view in FIG. 10*b*.

Clip 305 comprises of a resiliently flexible metal strip 1101 having a generally U-shaped side profile, in which the strip extends about generally 270 degrees of a circle, leaving an opening between the opposed ends 1102, 1103 of the metal strip. Clip 305 further comprises a pin 1104 projecting inwardly from its inner surface, configured to be received through aligned apertures of adjacent components of pole member 105.

Thus, in use, clip 305 is pressed against a side of the component being connected, such that the component passes between the opposed ends 1102, 1103, causing the ends to be pushed apart as the component passes therethrough, before returning to their original separation.

FIG. 12

Figure 12A:
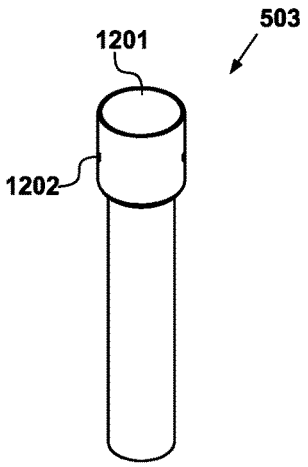
FIG. 12*a* is a perspective view of a nozzle.
Figure 12B:
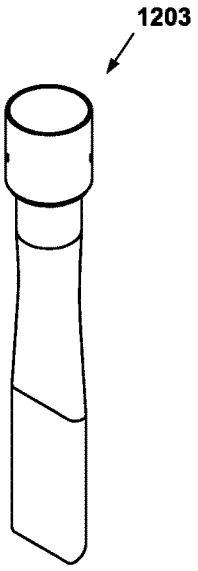
FIG. 12*b* is a perspective view of an alternative nozzle.
Figure 12C:
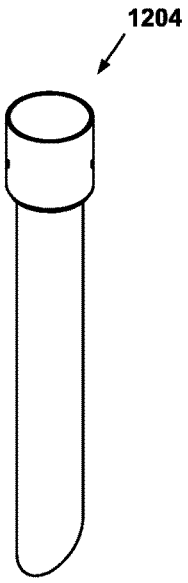
FIG. 12*c* is a perspective view of a further alternative nozzle.

A plurality of nozzles similar to nozzle 502 are illustrated in perspective view in FIGS. 12*a* to 12*c*.

Nozzle 503, previously illustrated with reference to FIG. 5, comprises of a short tubular nozzle, having an end 1201 configured to receive an end of said second stem portion 502, and defines a pair of diametrically opposed apertures 1202 which are configured to be aligned with diametrically opposed holes 507 of said second stem part, and through which blind rivets 404 are inserted to mechanically and electrically couple the nozzle 503 to the second stem part 502. Nozzle 503 is comprised of the same electrically conductive plastics material as said nozzle adapter socket 405, and is composed of a nylon plastics material filler containing a dispersion of micro-scale carbon black particles.

Alternative nozzles 1203, 1204, are illustrated in FIGS. 12*b* and 12*c*, which differ from nozzle 503 primarily in the shape of their end, in that nozzle 1203 narrows towards its end forming a crevice nozzle, and nozzle 1204 has a chamfered end and forms a spike tool. As will be appreciated, a number of alternative nozzles may be used in conjunction with the cleaning apparatus 101, for example, brush nozzles comprising a plurality of bristles arranged about their opening.

It will of course be appreciated by the skilled person, that although in the specific example illustrated, the cleaning apparatus is being used for cleaning a gutter, the cleaning apparatus has utility in relation to cleaning of a wide variety of alternative structures and areas, and in particular those situated at an elevated height above floor level, where the relatively long length of the pole member 105 facilitates cleaning of high areas by an operative standing on the floor.

In the specific example of the invention described herein, the apparatus is assembled, in as much as the pole member 105 is mechanically and electrically coupled to the hose member 106, which is in turn mechanically and electrically coupled to the vacuum unit 107, which vacuum unit is itself configured for connection to earth. It will of course be appreciated however that, primarily to facilitate easy transport of the apparatus, the various components of the apparatus may be supplied in kit form, ready for assembly by the operative 102 as has been described. In this respect, the invention extends to a kit of parts for assembling the cleaning apparatus 101, in which the pole member 105 and hose member 106 are provided separately, and configured to mechanically and electrically coupled as has been described. Further, a vacuum suction unit 107 may be provided, to which the hose member 106 may be mechanically and electrically coupled, which vacuum suction unit 107 may include conductive wiring to facilitate electrical coupling of the vacuum suction unit to earth.

What we claim is:

1. A cleaning apparatus comprising:

a flexible hose member comprised of an electrically conductive material and having first and second open ends, the hose member being suitable for attachment at its first end to a port of an associated suction unit to mechanically and electrically couple said hose thereto, said electrically conductive material being an electrically conductive plastics material; and a substantially rigid tubular pole member comprised of an electrically conductive material and having first and second open ends, said pole member being mechanically and electrically coupled at said first end to the second end of said hose member.

2. The cleaning apparatus of claim 1, in which said flexible hose member and said tubular pole member form a fluid conduit defining internally a substantially continuous passage extending between said first end of said hose member and said second end of said pole member.

3. The cleaning apparatus of claim 2, in which said flexible hose member further comprises a hose coupling apparatus comprised of an electrically conductive material, mechanically and electrically coupled to said first end of said hose member and suitable for attachment to a port of an associated vacuum unit to mechanically and electrically couple said hose thereto.

4. The cleaning apparatus of claim 3, in which said pole member further comprises a pole coupling apparatus comprised of an electrically conductive material, mechanically and electrically coupled to said first end of said pole member and mechanically and electrically coupled to said second end of said hose member.

5. The cleaning apparatus of claim 4, in which said hose coupling apparatus comprises a rotating adapter, said rotating adapter comprising first and second connector portions rotatably and electrically coupled, wherein said second connector portion is mechanically and electrically coupled to said hose member at said first end, and said first connector portion is suitable for attachment to a port of an associated vacuum suction unit to mechanically and electrically couple said hose to said suction unit.

6. The cleaning apparatus of claim 5, in which said pole member is comprised of a carbon-fibre reinforced polymer material.

7. The cleaning apparatus of claim 6, in which said pole member comprises of a plurality of interconnected pole sections.

8. The cleaning apparatus of claim 7, in which said pole sections are constructed from a carbon-fibre reinforced polymer material using the pultrusion process.

9. The cleaning apparatus of claim 8, in which pole sections of said plurality of pole sections are interconnected by partially inserting an end of a first said pole section into an end of a second said pole section.

10. The cleaning apparatus of claim 9, in which said plurality of interconnected pole sections are retained in the connected configuration by retaining clips which engage adjacent pole sections.

11. The cleaning apparatus of claim 10, in which said plurality of interconnected pole sections define apertures proximal their connecting ends configured to be aligned when an end of a first said pole section is partially inserted into an end of a second said pole section, and said retaining clips include a projecting element configured to be received through said aligned apertures in said interconnected configuration.

12. The cleaning apparatus of claim 11, further comprising a pole head component, mechanically and electrically coupled to said second end of said pole member to facilitate a suction cleaning operation.

13. The cleaning apparatus of claim 12, in which said pole head component comprises of an angled section of rigid tubing.

14. The cleaning apparatus of claim 13, in which said pole head component further comprises a nozzle apparatus mechanically and electrically coupled thereto.

15. The cleaning apparatus of claim 4 in which said hose coupling apparatus and said pole coupling apparatus each comprise of an electrically conductive plastics material.

16. The cleaning apparatus of claim 15, further comprising a vacuum suction unit, said vacuum suction unit defining a passage extending between an inlet port and an outlet port, and comprising a motor driven fan interposed in said passage and configured to generate a flow of air along said passage from said inlet port towards said outlet port.

17. The cleaning apparatus of claim 16, in which said vacuum suction unit includes an electrically conductive member proximal said inlet port, said electrically conductive member being configured for connection to electrical ground.

18. The cleaning apparatus of claim 17, in which said flexible hose member is mechanically coupled to said inlet port of said vacuum suction unit and electrically coupled to said electrically conductive member.

19. The cleaning apparatus of claim 18, in which said apparatus is configured as a high reach suction cleaning apparatus.

20. The cleaning apparatus of claim 1, in which said flexible hose member is an electrically conductive plastics tubing.

21. A kit of parts for assembling a cleaning apparatus, the kit comprising:

a flexible hose member comprised of an electrically conductive material and having first and second open ends, the hose member being suitable for attachment at its first end to a port of an associated suction unit to mechanically and electrically couple said hose thereto, said electrically conductive material being an electrically conductive plastics material; and a substantially rigid tubular pole member comprised of an electrically conductive material and having first and second open ends, said pole member being configured to be mechanically and electrically coupled at said first end to the second end of said hose member.

22. The kit of parts of claim 21, in which said flexible hose member and said tubular pole member are configured to form a fluid conduit defining internally a substantially continuous passage extending between said first end of said hose member and said second end of said pole member.

23. The kit of parts of claim 22, in which said flexible hose member further comprises a hose coupling apparatus comprising an electrically conductive material, the hose coupling apparatus being configured to be mechanically and electrically coupled to said first end of said hose member and suitable for attachment to a port of an associated vacuum unit to mechanically and electrically couple said hose thereto.

24. The kit of parts of claim 23, in which said pole member further comprises a pole coupling apparatus comprised of an electrically conductive material configured to be mechanically and electrically coupled to said first end of said pole member and configured to be mechanically and electrically coupled to said second end of said hose member.

25. The kit of parts of claim 24, in which said hose coupling apparatus comprises a rotating adapter, said rotating adapter comprising first and second connector portions rotatably and electrically coupled, wherein said second connector portion is configured to be mechanically and electrically coupled to said hose member at said first end, and said first connector portion is suitable for attachment to a port of an associated vacuum suction unit to mechanically and electrically couple said hose to said suction unit.

26. The kit of parts of claim 25, further comprising a vacuum suction unit, said vacuum suction unit defining a passage extending between an inlet port and an outlet port, and comprising a motor driven fan interposed in said passage and configured to generate a flow of air along said passage from said inlet port towards said outlet port.

27. A high reach cleaning apparatus comprising:

a flexible hose member comprised of an electrically conductive material and having first and second open ends, the hose member being suitable for attachment at its first end to a port of an associated suction unit to mechanically and electrically couple said hose thereto, said electrically conductive material being an electrically conductive plastics material; and a substantially rigid tubular pole member comprised of an electrically conductive material and having first and second open ends, said pole member being mechanically and electrically coupled at said first end to the second end of said hose member.

* * * * *